US009995488B2

(12) United States Patent
Harding

(10) Patent No.: US 9,995,488 B2
(45) Date of Patent: Jun. 12, 2018

(54) COMBUSTION CHAMBER AND A METHOD OF MIXING FUEL AND AIR IN A COMBUSTION CHAMBER

(71) Applicant: ROLLS-ROYCE plc, London (GB)

(72) Inventor: Stephen C. Harding, Bristol (GB)

(73) Assignee: ROLLS-ROYCE plc, London (GB)

( * ) Notice: Subject to any disclaimer, the term of this patent is extended or adjusted under 35 U.S.C. 154(b) by 433 days.

(21) Appl. No.: 14/965,968

(22) Filed: Dec. 11, 2015

(65) Prior Publication Data

US 2016/0097539 A1 Apr. 7, 2016

Related U.S. Application Data

(62) Division of application No. 13/494,401, filed on Jun. 12, 2012, now Pat. No. 9,291,351.

(30) Foreign Application Priority Data

Jul. 11, 2011 (GB) ..... 1111782.7

(51) Int. Cl.
*F23R 3/34* (2006.01)
*F23R 3/28* (2006.01)

(52) U.S. Cl.
CPC ..... *F23R 3/34* (2013.01); *F23R 3/28* (2013.01); *F23R 3/286* (2013.01)

(58) Field of Classification Search
CPC .... F23R 3/286; F23R 3/34; F23R 3/40; F23C 6/04; F23C 13/04; F23D 14/02; F23D 14/64
See application file for complete search history.

(56) References Cited

U.S. PATENT DOCUMENTS 4,339,924 A 7/1982 White et al.
5,619,855 A 4/1997 Burrus
5,623,819 A 4/1997 Bowker et al.
(Continued)

FOREIGN PATENT DOCUMENTS

GB 919647 A 2/1963
GB 1 489 339 A 10/1977

OTHER PUBLICATIONS

Oct. 21, 2011 Search Report issued in British Patent Application No. GB1111782.7.
Jun. 12, 2015 Office Action issued in U.S. Appl. No. 13/494,401.

*Primary Examiner* — Arun Goyal
(74) *Attorney, Agent, or Firm* — Oliff PLC

(57) ABSTRACT

A combustion chamber including a first fuel injector and a second fuel injector, the first and second fuel injectors being arranged to inject fuel into a mainstream flow of air with the second fuel injector arranged downstream of the first fuel injector. A method of mixing fuel and air in a combustion chamber, including injecting fuel into a mainstream flow of air with a first fuel injector; injecting fuel into the mainstream flow of air with a second fuel injector, which is arranged downstream of the first fuel injector; injecting fuel into the mainstream flow with the first fuel injector such that the resulting mixture between the first and second fuel injectors has an equivalence ratio less than the lean flame stability limit; and injecting fuel into the mainstream flow with the second fuel injector such that a combustion zone is provided downstream of the second fuel injector.

12 Claims, 4 Drawing Sheets

(56) References Cited

U.S. PATENT DOCUMENTS

| | | | | |
|---|---|---|---|---|
| 8,033,821 | B2 * | 10/2011 | Eroglu | F23C 7/002 431/12 |
| 8,066,509 | B2 * | 11/2011 | Eroglu | F23C 7/002 431/10 |
| 8,616,002 | B2 | 12/2013 | Kraemer et al. | |
| 2001/0026911 | A1 | 10/2001 | Neville et al. | |
| 2011/0185735 | A1 | 8/2011 | Snyder | |

* cited by examiner

COMBUSTION CHAMBER AND A METHOD OF MIXING FUEL AND AIR IN A COMBUSTION CHAMBER

This is a Division of application Ser. No. 13/494,401 filed Jun. 12, 2012, which claims the benefit of Great Britain Application No. 1111782.7 filed Jul. 11, 2011. The disclosure of the prior applications is hereby incorporated by reference herein in its entirety.

The present disclosure relates to a combustion chamber and particularly but not exclusively relates to a combustion chamber for a gas turbine engine.

BACKGROUND

As depicted in FIG. 1(*a*) conventional gas turbine combustion chambers 10 receive high pressure, high velocity air exiting from the compressor 20 of a gas turbine engine. (The air from the compressor 20 may exit via an Outlet Guide Vane 22.) This high pressure and high velocity air first enters a cavity 11 outside the combustion chamber 10. Most of this air then enters the combustion chamber 10 through the fuel injector 12, air admission ports and/or any cooling features, e.g. in the upstream end wall 14. A small remainder of the air also bypasses the combustion chamber 10 via passage 15. Some of this air in the bypass passage 15 may enter the combustion chamber via combustion chamber lining cooling ports 13 and the remainder may cool the turbine High Pressure Nozzle Guide Vanes 30 and/or any other turbine components.

In early combustion chambers, an example of which is shown in FIG. 1(*b*), the combustion chamber cowl 16 was extended forward into a snout 17 very close to the compressor exit. This snout 17 directs air into the combustion chamber 10 and allows the surplus air to pass into passage 15. By contrast, the later combustion chamber 10 shown in FIG. 1(*a*) has a smaller snout 17, although a diffuser 18 is provided at the compressor exit.

In both of the aforementioned examples, fuel is introduced directly into the combustion chamber via the fuel injector 12 where it is mixed with air and burnt in a single flame zone (per sector). In actuality some of the fuel burns immediately on meeting air in a "non-premixed" or "diffusion" flame mode. By contrast, in radially staged combustors, e.g. as shown in FIG. 1(*c*), the fuel is still sprayed directly into the combustion chamber 10 for mixing and burning, but two separate flame zones (per sector) inside the combustion chamber are defined. The first flame zone 19*a* is a pilot zone, whilst the second radially outer zone 19*b* is a main flame zone.

In order to optimise the performance of a conventional combustion chamber (whether radially staged or not) for emissions (Nitrogen oxides, e.g. NO and $NO_2$, Carbon monoxide, un-burnt hydrocarbons), the fuel and air have to be rapidly mixed prior to combustion in order to set up a flame of the required air to fuel ratio (AFR) or stoichiometry. In lean systems the flame must only predominantly exist where the fuel air mixture has mixed to a lean AFR. This is in order to prevent the combustion of fuel rich pockets that would result in high Nitrogen Oxide (NOx) emissions. However, achieving adequate mixing to minimise NOx production whilst maintaining combustion efficiency and stability is a challenging task. Furthermore, achieving acceptable relight at altitude, weak extinction, soot emissions, pressure loss and traverse performance add to the challenge.

The present disclosure therefore seeks to address these issues.

STATEMENTS OF INVENTION

According to a first aspect of the present invention there is provided a combustion chamber comprising a first fuel injector and a second fuel injector, the first and second fuel injectors being arranged to inject fuel into a mainstream flow of air with the second fuel injector arranged downstream of the first fuel injector, wherein the first fuel injector is configured to inject fuel into the mainstream flow such that the resulting mixture between the first and second fuel injectors has an equivalence ratio less than the lean flame stability limit and the second fuel injector is configured to inject fuel into the mainstream flow such that a combustion zone is provided downstream of the second fuel injector.

The combustion chamber may comprise a longitudinal axis. The mainstream flow may flow substantially in the longitudinal direction. The second fuel injector may be arranged downstream of the first fuel injector in a substantially longitudinal direction.

The resulting mixture between the first and second fuel injectors may have an equivalence ratio less than 0.5.

The combustion chamber may further comprise an expanding cowl portion adapted to receive the mainstream flow of air. The expanding cowl portion may expand in cross-sectional area in the direction of the mainstream flow, e.g. in the longitudinal direction.

The expanding cowl portion may be configured to longitudinally overlap with a diffuser portion, which may be arranged upstream of the combustion chamber. The diffuser portion may be arranged downstream of a compressor exit. The first fuel injector may be provided within the expanding cowl portion.

The first fuel injector may be provided adjacent to a compressor exit such that the fuel from the first fuel injector may be injected into a turbulent region downstream of the compressor exit.

A gas turbine engine may comprise the aforementioned combustion system. The gas turbine engine may further comprise a diffuser portion arranged upstream of the combustion chamber and downstream of a compressor exit. The expanding cowl portion may be configured to longitudinally overlap with the diffuser portion. The longitudinal axis of the combustion chamber may or may not be parallel to a longitudinal axis of the gas turbine engine.

According to a second aspect of the present invention there is provided a method of mixing fuel and air in a combustion chamber, the method comprising: injecting fuel into a mainstream flow of air with a first fuel injector; injecting fuel into the mainstream flow of air with a second fuel injector, the second fuel injector arranged downstream of the first fuel injector; injecting fuel into the mainstream flow with the first fuel injector such that the resulting mixture between the first and second fuel injectors has an equivalence ratio less than the lean flame stability limit; and injecting fuel into the mainstream flow with the second fuel injector such that a combustion zone is provided downstream of the second fuel injector.

The combustion chamber may comprise a longitudinal axis. The method may further comprise injecting fuel with the second fuel injector arranged downstream of the first fuel injector in a substantially longitudinal direction.

Fuel may be injected into the mainstream flow with the first fuel injector such that the resulting mixture between the first and second fuel injectors may have an equivalence ratio less than 0.5.

The mainstream flow may be passed through an expanding cowl portion adapted to receive the mainstream flow of air. The expanding cowl portion may expand in cross-sectional area in the direction of the mainstream flow.

The expanding cowl portion may longitudinally overlap a diffuser portion, which may be arranged upstream of the combustion chamber. The diffuser portion may be arranged downstream of a compressor exit. Fuel may be injected with the first fuel injector within the expanding cowl portion.

The first fuel injector may be provided adjacent to a compressor exit. Fuel may be injected with the first fuel injector into a turbulent region downstream of the compressor exit.

BRIEF DESCRIPTION OF THE DRAWINGS

For a better understanding of the present disclosure, and to show more clearly how it may be carried into effect, reference will now be made, by way of example, to the accompanying drawings, in which:—

DETAILED DESCRIPTION

Figure 1A:
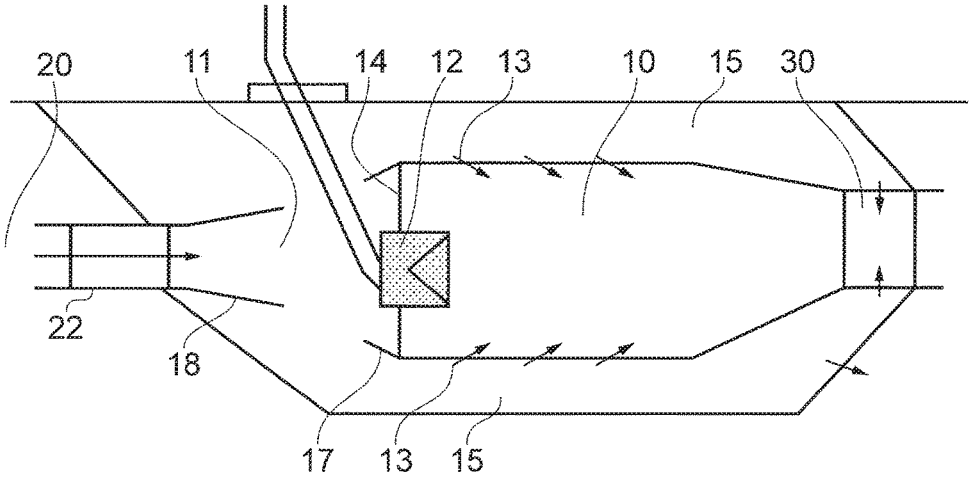
FIG. 1(a) BACKGROUND ART
FIGS. 1(*a*), 1(*b*) and 1(*c*) illustrate prior art combustion chambers.
Figure 1B:
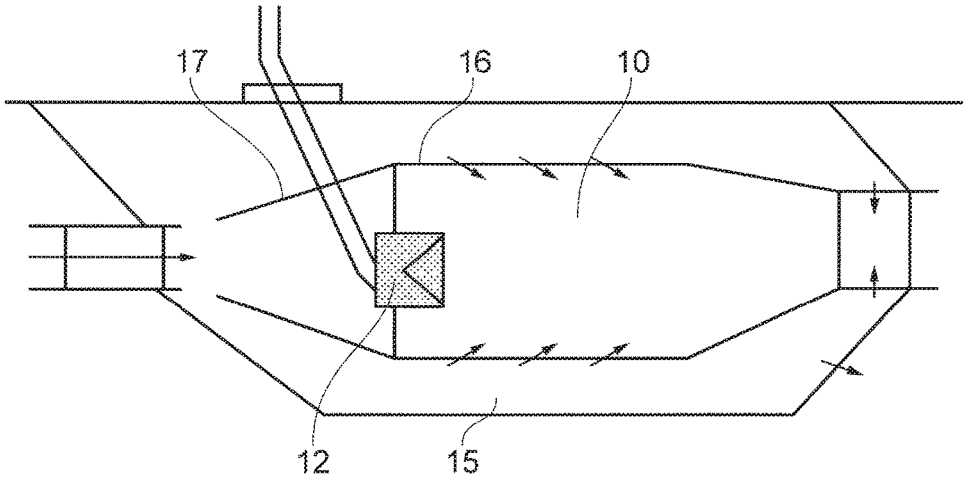
FIG. 1(b) BACKGROUND ART
Figure 1C:
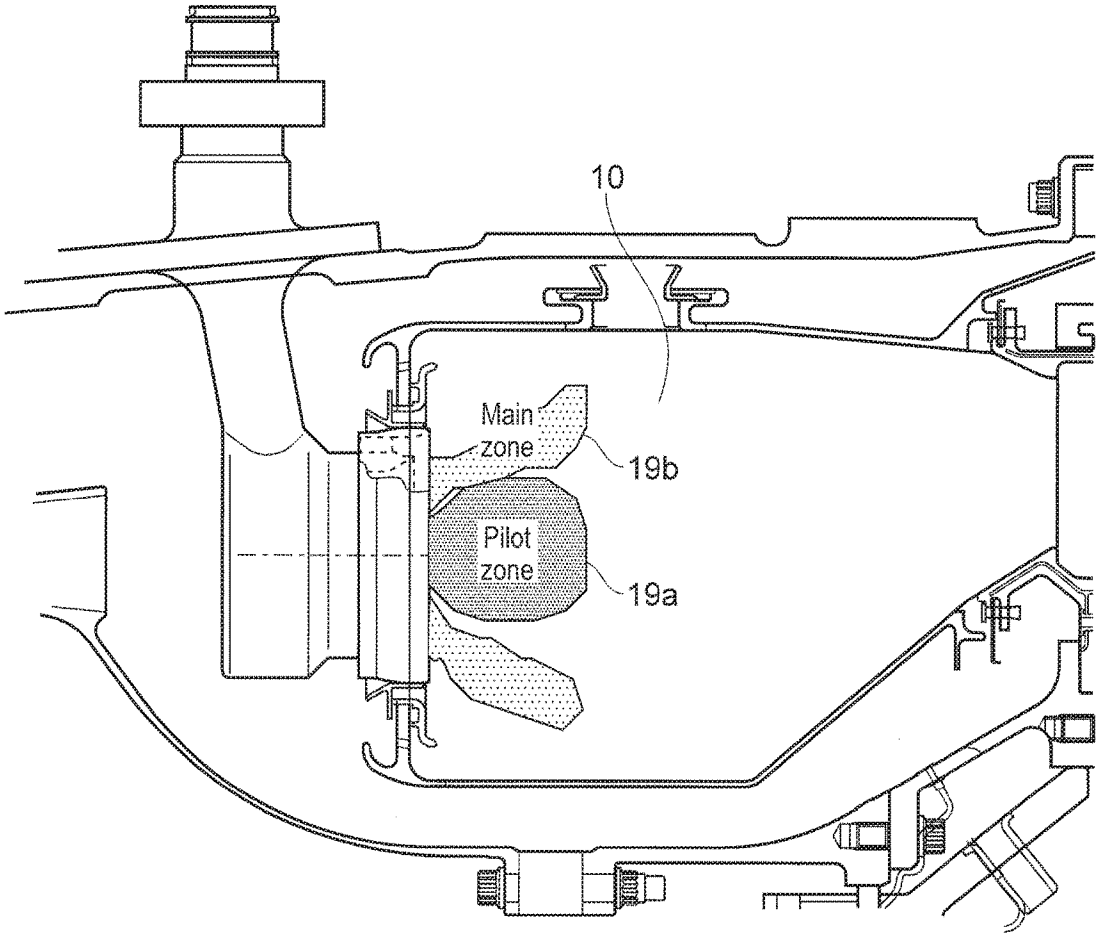
FIG. 1(c) BACKGROUND ART
Figure 2:
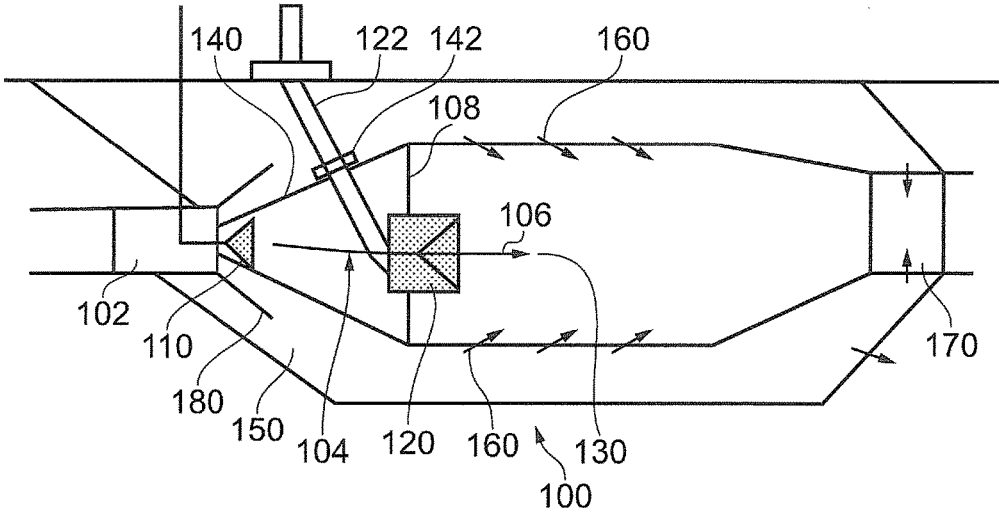
FIG. 2 illustrates a combustion chamber according to an example of the present disclosure.

With reference to FIG. 2, a combustion chamber 100 according to an example of the present disclosure comprises a first fuel injector 110 and a second fuel injector 120. The first and second fuel injectors 110, 120 may be arranged to inject fuel into a mainstream flow 106, e.g. of air, which flows through the combustion chamber 100. The combustion chamber 100 may form part of a gas turbine engine (not shown). The gas turbine engine may comprise a compressor (not shown), the combustion chamber 100 and a turbine (not shown) arranged in flow series. The combustion chamber 100 may be arranged downstream of the compressor exit, e.g. downstream of an Outlet Guide Vane (OGV) 102 provided at the compressor exit. A plurality of combustion chambers 100 may be provided arranged circumferentially around the axis of the gas turbine engine between the compressor and the turbine and said plurality of combustion chambers 100 may be equi-angularly distributed.

The first fuel injector 110 may be provided downstream of the compressor exit, e.g. downstream of the OGVs 102. The second fuel injector 120 may be arranged downstream of the first fuel injector 110 with respect to the mainstream flow 106 through the combustion chamber 100. The combustion chamber 100 may comprise a longitudinal axis, which may or may not be orientated in the same direction as a longitudinal axis of the gas turbine engine. The mainstream flow may flow through the combustion chamber 100 substantially in the longitudinal direction of the combustion chamber. The second fuel injector 120 may be arranged downstream of the first fuel injector 110 in a substantially longitudinal direction of the combustion chamber 100. The first and second fuel injectors may be longitudinally aligned.

The first fuel injector 110 may be configured to inject fuel into the mainstream flow 106 such that the resulting mixture 104 between the first and second fuel injectors 110, 120 has an equivalence ratio less than the lean flame stability limit to prevent combustion. Accordingly, the resulting mixture 104 between the first and second fuel injectors may have an equivalence ratio less than 0.5, e.g. below which any stable flame may not form, to prevent combustion.

As an aside it is noted that the equivalence ratio is defined as the ratio of the stoichiometric Air-to-Fuel Ratio (AFR) divided by the actual AFR and as such an equivalence ratio of 1.0 indicates stoichiometric conditions. Equally, it follows that the equivalence ratio is also defined by the ratio of the actual fuel to air ratio divided by the stoichiometric fuel to air ratio.

The second fuel injector 120 may be configured to inject the remainder of the fuel into the mainstream flow 106 such that the resulting mixture downstream of the second fuel injector 120 has an equivalence ratio greater than the lean flame stability limit, e.g. with an equivalence ratio greater than 0.5. As a result, a combustion zone 130 may be provided downstream of the second fuel injector 120. Approximately two-thirds of the fuel may be injected through the first fuel injector 110 and the remaining third may be injected through the second fuel injector 120. In any event, by at least partially pre-mixing the fuel and air, approximately two-thirds of the fuel may be sufficiently mixed for increased uniformity prior to combustion.

Thus, in contrast to conventional combustion systems, which rely on introducing all of the fuel in the combustion chamber at a single axial location, the present example introduces a proportion of the fuel prior to combustor entry at the first fuelling stage location. Accordingly, additional mixing of the fuel and air may be achieved between the first and second fuel injectors 110 and 120 and as a result a more uniform fuel-air mixture may be delivered to the combustion zone 130. As a result, the remaining fuel injected into the combustion chamber 100 via the second fuel injector 120 can be more easily optimised for lower total emissions, lower soot production and improved engine control via conventional simplified staging methods.

Combustion upstream of the second fuel injector 120 may be suppressed by having fuel flow rates into the first fuel injector 110 resulting in a mixture 104 below or significantly below the lean flame stability limit (e.g. with an equivalence ratio less than 0.5). Furthermore, locally flammable pockets may be avoided by rapid mixing in the high strain, high velocity and/or turbulent aerodynamic field in the region of the compressor exit 102, which suppresses combustion until the mixture has achieved an equivalence ratio greater than 0.5.

The combustion chamber 100 may further comprise an expanding cowl portion or snout 140. The expanding cowl portion 140 may be provided at an upstream end of the combustion chamber 100, and the expanding cowl portion 140 extends in an upstream direction from the upstream end 108 of the combustion chamber 100. The expanding cowl portion or snout 140 may be adapted to receive the mainstream flow of air, e.g. from the compressor exit. The expanding cowl portion 140 may expand in cross-sectional area in the direction of the mainstream flow, in a downstream direction, e.g. in the longitudinal direction of the combustion chamber 110. By way of example, the expanding cowl portion 140 may be frustoconical.

A portion of the flow from the compressor exit 102 may flow outside of the expanding cowl portion 140 and this flow may enter a bypass passage 150. The flow in the bypass passage 150 may then enter the combustion chamber 100 via combustion chamber lining cooling ports 160 and the remainder may cool the turbine High Pressure Nozzle Guide Vanes 170 and/or any other turbine components.

A diffuser portion 180 may be provided downstream of the compressor exit 102. The diffuser portion 180 may expand in cross-sectional area in the direction of the mainstream flow, in a downstream direction. By way of example, the diffuser portion 180 may be frustoconical. The expanding cowl portion 140 may longitudinally overlap the diffuser portion 180. In other words, the upstream end of expanding cowl portion or snout 140 of the combustion chamber 100 may extend into the diffuser portion 180, e.g. the upstream end of the expanding cowl portion or snout 140 is upstream of the downstream end of the diffuser portion 180. As depicted, there may be no mechanical connection between the expanding cowl portion 140 and the diffuser portion 180. Accordingly, the diffuser portion 180 may be greater in size, e.g. diameter, than the expanding cowl portion 140 at a particular longitudinal location.

Figure 3:
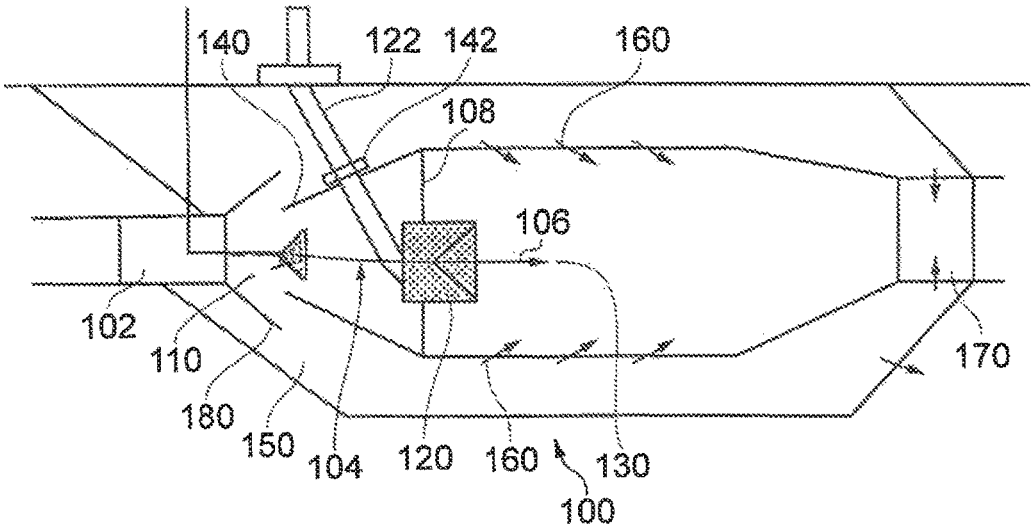
FIG. 3 illustrates a combustion chamber according to an alternative example of the present disclosure.

In an alternative arrangement shown in FIG. 3, the diffuser portion 180 and expanding cowl portion 140 may not overlap. As such, there may be a longitudinal gap between the diffuser portion 180 and the expanding cowl portion 140, e.g. the upstream end of the expanding cowl portion 140 is downstream of the downstream end of the diffuser portion 180.

As depicted in FIG. 2, the first fuel injector 110 may be provided within the expanding cowl portion 140. In other words, the first fuel injector 110 may have its injection point downstream of the snout entry. The fuel may be introduced downstream of the start of the snout in order to prevent fuel entering the bypass passage 150, e.g. the external aerodynamics air stream. The first fuel injector 110 is positioned at the upstream end of the expanding cowl portion or snout 140.

The second fuel injector 120 is positioned within an aperture in the upstream end wall 108 of the combustion chamber 100. The second fuel injector 120 may be arranged with a fuel supply stem 122 passing through the expanding cowl portion 140 (as shown). Alternatively, fuel may be fed to the second fuel injector 120 through a manifold integral to the combustion chamber head 108 to avoid the need for a seal between the expanding cowl portion 140 and the stem 122.

However, if the second fuel injector 120 is mounted such that its fuel supply stem 122 passes through the expanding cowl portion 140, then a seal 142, which may be flange shaped, may be provided between the stem 122 and the wall of the expanding cowl portion 140. The seal 142 may prevent fuel from the mixture 104 entering the bypass passage 150. Fuel may also be prevented from entering the bypass passage 150 by a pressure distribution which may be set up to ensure the pressure in the bypass passage 150 is greater than inside the expanding cowl portion 140, thereby creating a positive flow into the expanding cowl portion 140 across the seal 142.

The first fuel injector 110 may be fed by a separate fuel manifold than for the second fuel injector 120. The fuel manifold for the first fuel injector 110 may not be actively controlled by a control system relative to the manifold for the second fuel injector 120. The fuel supply to the first and second fuel injectors 110, 120 may be passively split according to the fuel pressure in the two fuel manifolds (one feeding the first fuel injector and the other feeding the second fuel injector).

The first fuel injector manifold may be integral with the OGV 102 at the compressor exit. For example, the first fuel injector 110 may be connected to an OGV 102 at the compressor exit such that fuel may be supplied to the first fuel injector 110 through the OGV 102. Accordingly, fuel may be supplied to the first fuel injector 110 from outside the compressor casing. The fuel may flow at least partially through the OGV 102 in a span-wise direction and then to the first fuel injector 110 in a chordwise direction, e.g. through a passage in the OGV 102. Such an arrangement may negate the need for a fuel supply stem or pigtails to the first fuel injector 110.

Although the present invention has been described with reference to a gas turbine engine having a plurality of combustion chambers arranged circumferentially around the axis of the gas turbine engine between the compressor and the turbine it is equally applicable to gas turbine engine having a single annular combustion chamber provided circumferentially around the axis of the gas turbine engine between the compressor and the turbine. In this case a plurality of circumferentially spaced first fuel injectors are provided and a plurality of circumferentially spaced second fuel injectors are provided and the second fuel injectors are arranged downstream of the first fuel injectors. The first fuel injectors may be equi-angularly spaced and the second fuel injectors may be equi-angularly spaced. A plurality of mainstream flows are provided into the annular combustion chamber. A respective one of the first fuel injectors and a respective one of the second fuel injectors are arranged to inject fuel into a respective one of the mainstream flows, e.g. of air, which flows into and through the combustion chamber. The annular combustion chamber has a plurality of apertures in the upstream end wall and each one of the second fuel injectors is positioned in a respective one of the apertures in the upstream end wall of the combustion chamber. Each one of the mainstream flows passes through a respective one of the apertures in the upstream end wall of the annular combustion chamber and the associated second fuel injector.

An advantage of this invention is that additional fuel-air mixing can be achieved upstream of the combustor using fuel in the first location prior to combustion and in an environment more amenable to achieving uniform mixing. It is currently challenging to achieve rapid, fuel air mixing without combustion in the main combustor. However, by performing some mixing upstream of the combustor, the advantages of residence time, geometry and space all allow the mixing to be better controlled and effected. The mixture entering the main combustor is already partially premixed and a reduced amount of fuel air mixing is necessary to prepare a uniform mixture for delivery to the flame front.

When the premixed fuel and air joins the additional fuel from the second location, the flame will burn as a more uniform mixture thereby allowing reduced NOx emissions and more control over the combustor's performance. Ultimately, this leads to lower emissions of all species, which is important with regard to the Committee on Aviation Environmental Protection (CAEP) legislation and the Advisory Council for Aeronautical Research in Europe (ACARE) goals for reducing emissions.

Whilst the above example has been described with reference to a gas turbine combustion chamber, the principle of introducing a preliminary fuel-air mixing stage below the flammability limit may equally be applied in piston engine intakes, silo combustors or furnace pre-mixers/intakes.

The invention claimed is:

1. A combustion chamber comprising:

an upstream end wall including one aperture or a plurality of circumferentially arranged apertures;

a first set of fuel injectors comprising either one fuel injector or a plurality of fuel injectors arranged circumferentially and a second set of fuel injectors comprising one fuel injector or a plurality of fuel injectors arranged circumferentially, each first fuel injector of the first set of fuel injectors and a corresponding second fuel injector of the second set of fuel injectors being aligned with a respective one of the apertures, the first set of fuel injectors and the second set of fuel injectors injecting all fuel required for the combustion chamber, each of the first fuel injector and the corresponding second fuel injector being arranged to inject the fuel into a respective mainstream flow of air with each of the first fuel injector being arranged upstream of the corresponding second fuel injector, each of the first fuel injector being configured to inject the fuel into the respective mainstream flow such that a resulting mixture between the first fuel injector and the second fuel injector has an equivalence ratio less than a lean flame stability limit, and each of the second fuel injector being configured to inject the fuel into the respective mainstream flow such that a combustion zone is provided downstream of the second fuel injector or second fuel injectors, each of the second fuel injector having an injection point provided within each respective one of the apertures in the upstream end wall of the combustion chamber;

a diffuser portion having an inlet and an outlet, the diffuser portion being arranged upstream of the combustion chamber and downstream of a compressor exit; and an expanding cowl portion extending in an upstream direction from the upstream end wall of the combustion chamber towards the compressor exit, the expanding cowl portion having an upstream end arranged upstream of the combustion chamber, downstream of the compressor exit, and downstream of the outlet of the diffuser portion, the expanding cowl portion being configured to receive the mainstream flow of air, the expanding cowl portion expanding in a cross-sectional area in a direction of the mainstream flow, each of the first fuel injector and each of the second fuel injector being provided within the expanding cowl portion, and each of the first fuel injector being disposed at an upstream portion of the expanding cowl portion and each of the second fuel injector being disposed at a downstream portion of the expanding cowl portion.

2. The combustion chamber of claim 1, further comprising a longitudinal axis, each of the second fuel injector being arranged downstream of each of the first fuel injector in a direction substantially along the longitudinal axis.

3. The combustion chamber of claim 1, wherein the resulting mixture between the first fuel injector and the second fuel injector has an equivalence ratio less than 0.5.

4. The combustion chamber of claim 1, wherein each of the first fuel injector is provided adjacent to the compressor exit such that the fuel from each of the first fuel injector is injected into a turbulent region downstream of the compressor exit.

5. A gas turbine engine comprising the combustion chamber of claim 1.

6. The combustion chamber of claim 1, wherein each of the first fuel injector is positioned at the upstream end of the expanding cowl portion.

7. The combustion chamber of claim 1, further comprising a first fuel injector manifold, arranged to supply the fuel to each of the first fuel injector, being integral with an outlet guide vane at the compressor exit.

8. The combustion chamber of claim 7, wherein each of the first fuel injector is connected to the outlet guide vane at the compressor exit such that the fuel is supplied to each of the first fuel injector through the outlet guide vane.

9. The combustion chamber of claim 8, wherein the outlet guide vane has a passage to supply the fuel in a span-wise direction of the outlet guide vane and then in a chord-wise direction of the outlet guide vane to each of the first fuel injector.

10. The combustion chamber of claim 1, wherein a fuel supply stem of each of the second fuel injector passes through the expanding cowl portion.

11. The combustion chamber of claim 10, wherein a seal is provided between the fuel supply stem and the expanding cowl portion.

12. The combustion chamber of claim 1, further comprising a second fuel injector manifold, arranged to supply the fuel to each of the second fuel injector, being integral with the upstream end wall of the combustion chamber.

* * * * *